United States Patent [19]

Regan

[11] 4,161,045

[45] Jul. 17, 1979

[54] MATTRESS

[76] Inventor: John J. Regan, 2316 N. Harlem Ave., Elmwood Park, Ill. 60635

[21] Appl. No.: 861,961

[22] Filed: Dec. 19, 1977

[51] Int. Cl.[2] ..... A47C 23/00; A47C 27/00

[52] U.S. Cl. ..... 5/464; 5/447; 5/448; 5/481

[58] Field of Search ..... 5/91, 345 R, 353, 355, 5/361 B

[56] References Cited

U.S. PATENT DOCUMENTS

| | | | |
|---|---|---|---|
| 3,534,416 | 10/1970 | Ackermann | 5/345 R |
| 3,885,258 | 5/1975 | Regan | 5/345 R |
| 4,053,957 | 10/1977 | Regan | 5/355 |

*Primary Examiner*—Casmir A. Nunberg

*Attorney, Agent, or Firm*—Wegner, Stellman, McCord, Wiles & Wood

[57] ABSTRACT

A mattress of improved support having planar top and bottom surfaces is provided with at least two sets of transversely extending ribs. The ribs, which may be continuous or discontinuous, are less compressible than the material of the mattress and are spaced apart longitudinally from each other within each set. The sets are spaced apart longitudinally to correspond in position to the shoulder area and buttocks area of the user to provide maximum support for body areas of greater weight, and hold the body generally straight. Another embodiment of the invention employs relatively small support plates uniformly distributed between the layers of a multi-layer mattress to provide uniform support over the entire area of the mattress.

23 Claims, 9 Drawing Figures

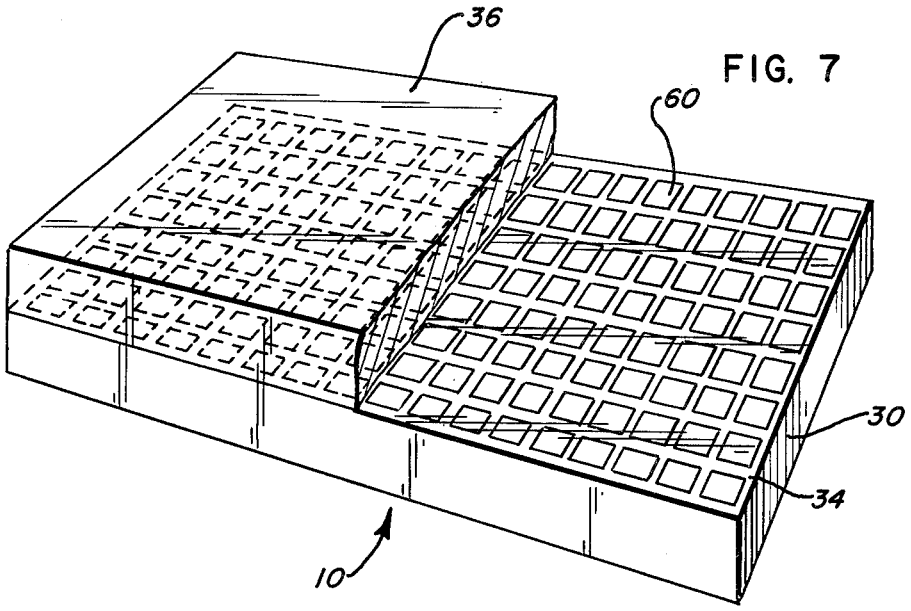
FIG. 7
FIG. 8
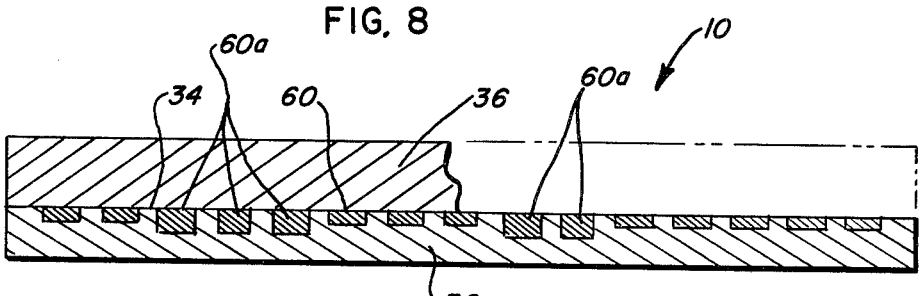
FIG. 9
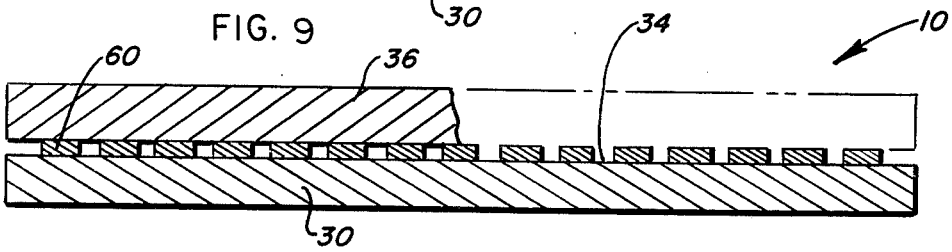

MATTRESS

BACKGROUND OF THE INVENTION

My U.S. Pat. No. 3,885,258 discloses a multi-layer mattress which minimizes bodily irritations and supports the user's body in a level condition by providing maximum support in areas of greatest weight to prevent "hammocking" of the body. Such support is provided by an intermediate, relatively rigid support layer with a contoured surface having an inverted relationship to the relatively heavy areas of the human body.

My U.S. Pat. No. 4,053,957 provides a multi-layer mattress with another means of enhancing support of the relatively heavy areas of the body. Two transversely extending ribs of less compressibility than the material of the mattress's upper layer extend across a lower layer and are received in complementary recesses in the upper layer. Each support area in U.S. Pat. No. 4,053,957 is unitary and comprises one rib of a relatively large cross section.

Each of my prior patents provides uniform support in the user's shoulder area, buttocks area, etc. It has been found that it may be desirable to apply various degrees of localized support within the areas of enhanced support, since the force exerted by the body in these areas is not uniform, and to provide for shifting of body weight during sleep.

SUMMARY OF THE INVENTION

According to the present invention, a single- or multi-layered mattress is provided which prevents "hammocking" of the human body by providing several sets of support ribs of relatively low compressibility which extend transversely of the mattress and which are spaced longitudinally apart from one another at points corresponding to the areas of greatest body weight. The ribs extend substantially entirely across the mattress, and each rib is of a width substantially less than the width of an area to be supported. The low compressibility of the ribs has the effect of decreasing the overall compressibility of the mattress at those points where the ribs are located.

Within each set, one or more of the ribs may be of a larger cross section than the remaining ribs in order to provide localized support within the area of that set. Alternately, ribs of similar size may be disposed vertically from one another as well as horizontally so as to provide localized support relatively close to the level of the user's body.

One embodiment of the invention utilizes discontinuous ribs to provide independent support within an area of enhanced support.

A still further embodiment of the invention provides a multi-layer mattress with relatively small support plates dispersed between the mattress layers to provide independent support at selected points on the mattress.

Further features and advantages of the invention will readily be apparent from the following specification taken in connection with the accompanying drawings.

BRIEF DESCRIPTION OF THE DRAWINGS

FIG. 7 is a perspective view of a mattress embodying a still further form of the invention;

FIG. 8 is a longitudinal sectional view of the mattress of FIG. 7; and

FIG. 9 is a longitudinal sectional view of a modified form of the mattress of FIG. 7.

DESCRIPTION OF THE PREFERRED EMBODIMENT

Figure 1:
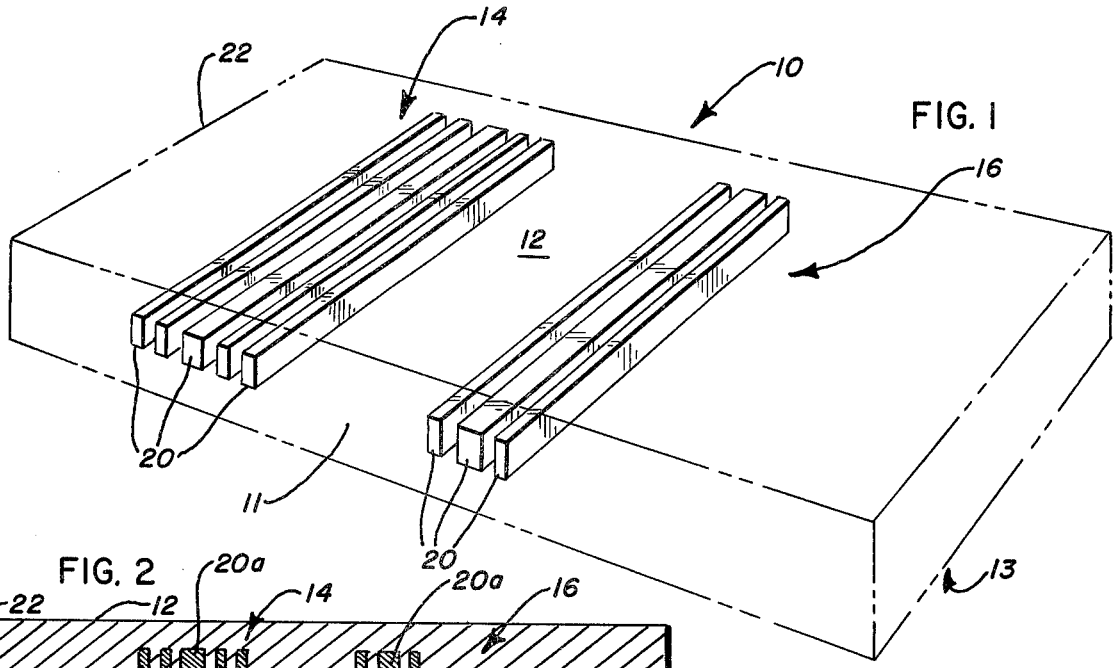
FIG. 1 is a perspective view of a mattress embodying the present invention, with the outline of the mattress shown in broken lines.

FIG. 1 illustrates a mattress, generally designated 10, embodying the present invention. The mattress 10 is illustrated as a single layer 11 of a resilient material, such as molded foam, but it is to be understood that the mattress 10 may be fabricated from two similar or dissimilar layers, as described below.

The mattress 10 has a generally planar, body supporting top surface 12 and a generally planar, support engaging bottom surface 13. The mattress support is not shown, for simplicity.

Disposed within the mattress 10 are two sets 14 and 16 of support ribs 20. Each rib 20 is of a material of less compressibility than the material of the mattress layer 11 and extends substantially entirely across the width of the mattress 10. Although the ribs 20 illustrated in FIGS. 1 through 6 are of rectangular cross section, they need not be rectangular, but may be of a circular cross section or of another desired configuration.

Each set 14 and 16 is positioned within the mattress 10 to correspond to the areas of greatest weight of a user (not shown) lying on the top surface 12. In FIG. 1, if the head of the user is closest to the end 22 of the mattress 10, the set 14 corresponds to the shoulder area of the user and the set 16 corresponds to the area of the user's buttocks. A sufficient number of ribs 20 is provided in each set 14 and 16 to provide a sufficiently wide support area. Although only two sets of ribs are shown in FIG. 1, it is to be understood that additional ribs may be provided for the calf area, the head area, etc.

It is readily apparent that, upon the application of body weight to the mattress 10, each rib 20 is compressible independently of the others, thereby supplying the greatest resistance to compression in those areas where the heaviest force is applied.

Figure 2:
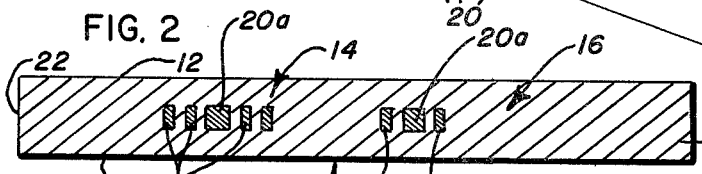
FIG. 2 is a longitudinal sectional view of FIG. 1.

Referring now to FIG. 2, one rib **20*a* in each set 14 and 16 is illustrated to be of a relatively great cross sectional area relative to the remaining ribs 20**. A rib with a relatively great cross sectional area provides a proportionately greater resistance to compression and, therefore, provides localized support with a given set of ribs. Such localized support is desirable because the human body exerts a variable compressive force even within an area of relatively great weight, such as the shoulder or buttocks area.

Figure 3:
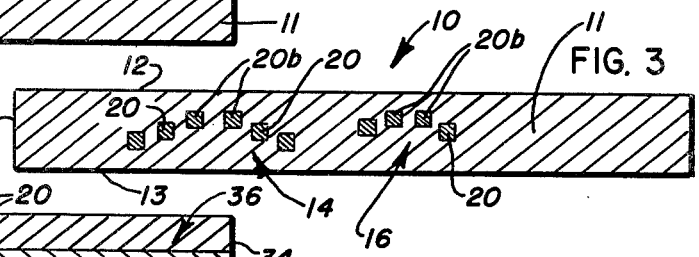
FIG. 3 is a longitudinal sectional view of a modified embodiment of the invention.

Referring to FIG. 3, an alternative embodiment of the invention is illustrated. The ribs 20 are of similar cross sectional area, but are spaced slightly vertically apart from one another, as well as horizontally, within each set 14 and 16. Each set 14 and 16 of FIG. 3 has the shape of a flattened, inverted U in order to provide a localized area of extra support within each set 14 and 16. The centrally disposed ribs 20*b* of each set 14 and 16 provide greater support than the peripheral ribs 20 due to the relatively small amount of resilient material between the body-supporting top surface 12 and the central ribs 20*b*.

Figure 4:
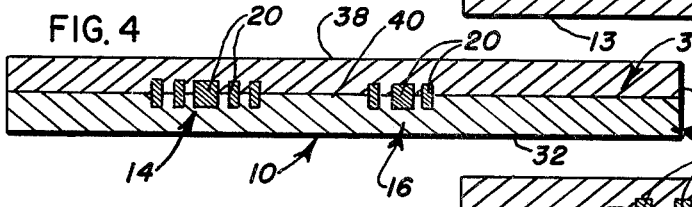
FIG. 4 is a longitudinal sectional view of a multi-layer mattress made according to the invention.

A method of manufacturing a mattress according to the invention is to join two similar or dissimilar layers of resilient material, as by an adhesive, with at least two sets of less compressible ribs disposed therebetween. FIG. 4 illustrates such a construction. The mattress 10 of FIG. 4 includes a lower layer 30 with a planar support engaging bottom surface 32 (support not shown), and a generally planar top surface 34. An upper layer 36 has a planar body supporting top surface 38 and a planar bottom surface 40 which engages the upper surface 34 of the lower layer 30. Two sets 14 and 16 of ribs 20 lie transversely across the lower layer 30 at desired points, as in FIGS. 1 through 3. Each rib 20 lies in a recess within the lower layer 30 or, if the lower layer 30 is of less resilience than the upper layer 36, each rib 20 may be molded from the lower layer 30 as a unitary component thereof. Each rib 20 is received in a complementary recess in the upper layer 36.

The lower layer 30 and the upper layer 36 may be of the same resilience, or the upper layer 36 may be of greater resilience than the lower layer 30 to provide softness to the user. In either case, the ribs 20 are less compressible than the upper layer 36 in order to provide enhanced localized support.

Figure 5:
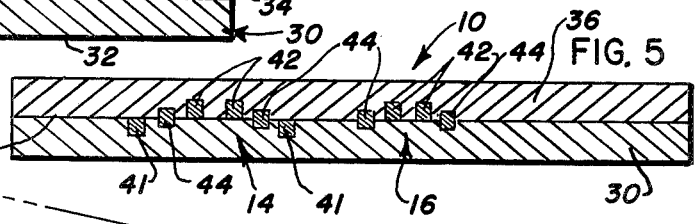
FIG. 5 is a longitudinal sectional view of a modified form of a multi-layer mattress made according to the invention.

FIG. 5 illustrates a multi-layer mattress 10 comprising a lower layer 30 and an upper layer 36, similar to the corresponding layers of FIG. 4, with two sets 14 and 16 of ribs 41–44 of similar cross section disposed between the layers 30 and 36 in an inverted flattened U, to serve the same function as the ribs 20 in FIG. 3. In the case of FIG. 5, some ribs 41 lie entirely within the lower layer 30, some ribs 42 lie entirely within the upper layer 36, and some ribs 44 extend into the upper layer 36 from within the lower layer 30.

Figure 6:
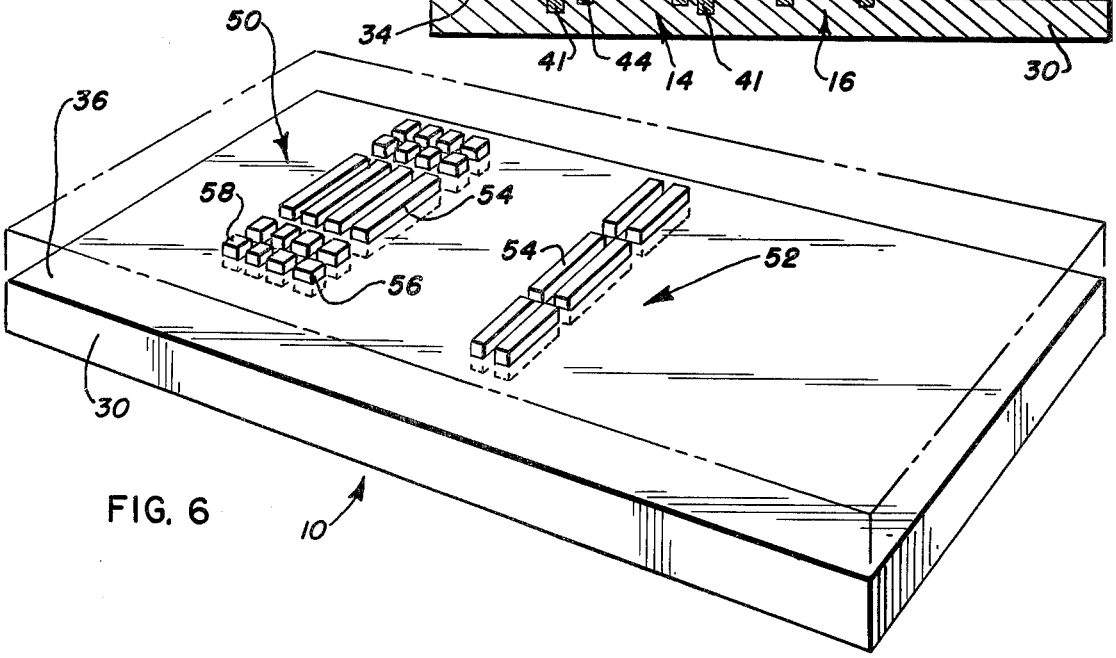
FIG. 6 is a perspective view of a mattress embodying a further form of the invention.

FIG. 6 illustrates another multi-layer mattress 10 comprising a lower layer 30 and an upper layer 36, such as seen in FIGS. 4 and 5. The mattress 10 of FIG. 6 has two sets 50 and 52 of support members 54 and 56 of various lengths. For example, the set 50 illustratively includes support ribs 54 of greater length than width, and further includes support members 56 of generally cubical shape. Each support member 56 has relatively small top cross sectional area 58. As in FIG. 4, the members 54 and 56 extend from recesses in the lower layer 30 into complementary recesses in the upper layer 36. The set 52 comprises support members similar to the ribs 54.

As in the above illustrations, the support members 54 and 56 are less compressible than the top layer 36 of the mattress 10. The use of the relatively small independent support members 54 and 56 allows the compression of one or several of the support members 54 and 56 without compression of the remaining support members 54 and 56, thereby providing independent support to the body within the areas of greatest support.

FIGS. 7–9 illustrate yet another multi-layer mattress 10 comprising a lower layer 30 and an upper layer 36 similar to those of FIGS. 4 and 5. The mattress 10 includes a relatively great number of small support plates 60 dispersed over the top surface 34 of the lower layer 30. The plates 60 may be distributed uniformly, as in FIGS. 7–9, or they may be distributed non-uniformly in a pattern corresponding to the areas of greatest weight of a user's body.

As seen in FIG. 8, the plates 60 may be disposed within suitable recesses in the layer 30 or they may be glued or otherwise attached (as by tying together) to the surface 34, as seen in FIG. 9. Some plates 60*a* may be of greater thickness than the remaining plates 60 to provide additional support in selected areas, as seen in FIG. 8, whether the plates 60 and 60*a* are distributed uniformly or non-uniformly. Each plate 60 in FIG. 9 is sufficiently thin to allow the upper layer 36 to be disposed thereover and still to be securely fixed to the lower layer 30. (The thickness of the plates 60 in FIG. 9 are exaggerated for clarity.)

Provision of a number of dispersed support plates over the top surface 34 of the lower layer 30 allows a great degree of independent support at selected points of the surface of the mattress, regardless of the user's size or change of position during sleep.

The foregoing detailed description is given for clearness of understanding only and no unnecessary limitations should be understood therefrom, as modifications will be obvious to those skilled in the art.

I claim:

1. In a mattress comprising a single layer of a resilient material and having a generally planar body-supporting top surface and a generally planar support-engaging bottom surface, the improvement which comprises:

first and second pluralities of individual ribs of less compressibility than the material of said mattress extending transversely through said mattress, the ribs of each plurality being spaced apart laterally of each other in the longitudinal direction of the mattress whereby each said individual rib is independently compressible, said first and second pluralities being spaced apart longitudinally of the mattress and positioned to support only the shoulders and buttocks of one lying on the mattress, the lesser resilience of the ribs complementing the greater resilience of the mattress material to support the body lying on the mattress in a generally straight attitude.

2. The mattress of claim 1 wherein at least one of said pluralities of ribs includes ribs of various cross sections.

3. The mattress of claim 1 wherein the ribs of at least one of said pluralities are spaced apart vertically from each other in order to provide increased localized support.

4. In a multi-layered mattress, including:

a lower layer having a support-engaging bottom surface and a generally planar top surface, and an upper layer having a bottom surface engaging the top surface of the lower layer and a top, body-supporting surface, the improvement which comprises:

a first set of ribs of less compressibility than the upper layer extending transversely across and upwardly from the planar top surface of the lower layer into complementary recesses in the bottom surface of the upper layer, said ribs of said first set being spaced apart laterally from each other in the longitudinal direction of the mattress within said first set, and a second set of ribs of less compressibility than the upper layer spaced longitudinally from the first set on the lower layer and extending transversely across and upwardly from the top planar surface of the lower layer into complementary recesses in the bottom surface of the upper layer, said ribs in said second set being spaced apart laterally from each other in the longitudinal direction of the mattress, said first and second sets being spaced apart longitudinally of the mattress and positioned to support the shoulders and buttocks of one lying on the mattress, the lesser compressibility of the ribs complementing the resilience of the upper layer to support the body lying on the mattress in a straight attitude.

5. The mattress of claim 4 wherein the resilience of the material of the upper layer is greater than the resilience of the material of the lower layer.

6. The mattress of claim 4 wherein the resilience of the material of the upper and lower layers is substantially the same.

7. The mattress of claim 4 wherein the ribs of at least one set are of various transverse cross sections.

8. The mattress of claim 4 wherein each said set of ribs further includes ribs extending exclusively through one of said upper and lower layers.

9. The mattress of claim 4 wherein the ribs of at least one set are discontinuous.

10. In a multi-layer mattress, including:

a lower layer having a generally planar, supportengaging bottom surface and a generally planar top surface, and an upper layer having a bottom surface engaging the top surface of the lower layer and a generally planar top, body-supporting surface, the improvement which comprises:

a plurality of flat support members of greater rigidity than said layers disposed between said layers over substantially the entire area of the top surface of the lower layer whereby increased support is provided to relatively heavy areas of the body of a user lying on the top surface of the upper layer.

11. The mattress of claim 10 wherein said support members are disposed within recesses formed in the top surface of the lower layer.

12. The mattress of claim 10 wherein said support members are fixed to the top surface of the lower layer.

13. The mattress of claim 10 wherein means are provided to secure each said support member to other support members in said plurality.

14. The mattress of claim 10 wherein a number of said support members are of thickness greater than that of the remainder of said support members.

15. The mattress of claim 14 wherein said relatively thick support members are positioned to support only the shoulders and buttocks of a user.

16. The mattress of claim 10 wherein said support members are disposed within recesses formed in the bottom surface of the upper layer.

17. The mattress of claim 10 wherein a plurality of said support members are disposed in recesses formed in the bottom surface of said upper layer and the remainder of said support members are disposed in recesses formed in the top surface of said lower layer.

18. the mattress of claim 17 wherein the members disposed in said recesses in said upper layer bottom surface are positioned to support only the shoulders and buttocks of a user.

19. The mattress of claim 17 wherein the members disposed in said recesses in said lower layer top surface are positioned to support only the shoulders and buttocks of a user.

20. The mattress of claim 10 wherein said rigid support members comprise longitudinal ribs.

21. The mattress of claim 20 wherein said ribs are discontinuous in the longitudinal direction of said ribs.

22. The mattress of claim 20 wherein the longitudinal dimension of said ribs is less than the transverse dimension of said mattress, and each said rib is positioned generally centrally of said mattress with respect to the transverse direction of said mattress.

23. The mattress of claim 10 wherein said support members comprise plates.

* * * * *